US007444981B2

(12) United States Patent
Ashida

(10) Patent No.: US 7,444,981 B2
(45) Date of Patent: Nov. 4, 2008

(54) INTERNAL-COMBUSTION ENGINE AND METHOD OF DISPOSING IGNITION PLUG THEREOF

(75) Inventor: Masaaki Ashida, Yokohami (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/794,425

(22) PCT Filed: Apr. 13, 2006

(86) PCT No.: PCT/IB2006/051166

§ 371 (c)(1),
(2), (4) Date: Jun. 27, 2007

(87) PCT Pub. No.: WO2006/111908

PCT Pub. Date: Oct. 26, 2006

(65) Prior Publication Data

US 2008/0078365 A1 Apr. 3, 2008

(30) Foreign Application Priority Data

Apr. 18, 2005 (JP) ..... 2005-119432
Apr. 18, 2005 (JP) ..... 2005-119436

(51) Int. Cl.
*F02P 15/02* (2006.01)
*F02P 15/08* (2006.01)

(52) U.S. Cl. ..... 123/310; 123/309

(58) Field of Classification Search ..... 123/310, 123/309, 169 R, 169 EL, 169 MG, 635, 638, 123/308
See application file for complete search history.

(56) References Cited

U.S. PATENT DOCUMENTS 4,805,570 A 2/1989 Davis
5,261,367 A * 11/1993 Yamamoto et al. ..... 123/309
5,465,695 A * 11/1995 Yamamoto et al. ..... 123/256
6,575,133 B2 * 6/2003 Ries-Mueller et al. ..... 123/306
7,207,312 B2 * 4/2007 Inoue et al. ..... 123/310
7,234,441 B2 * 6/2007 Isaji et al. ..... 123/309
2006/0201480 A1 * 9/2006 Isaji et al. ..... 123/310
2006/0213480 A1 * 9/2006 Inoue et al. ..... 123/310
2007/0056556 A1 * 3/2007 Yohso et al. ..... 123/308

FOREIGN PATENT DOCUMENTS

DE 4229008 3/1993

(Continued)

OTHER PUBLICATIONS

PCT International Search Report No. PCT/IB06/051166 dated Nov. 17, 2006.

*Primary Examiner*—Mahmoud Gimie
(74) *Attorney, Agent, or Firm*—Global IP Counselors, LLP

(57) ABSTRACT

An internal-combustion engine is disclosed in which a pair of inlet valves and a pair of outlet valves are provided within the combustion chamber formed in each of a row of cylinders. A first ignition plug is disposed in the cylinder head within a central area of the combustion chamber in plan view. Second and third ignition plugs are disposed in the cylinder head at opposite peripheral portions of the combustion chamber positioned approximately along the first axis direction in plan view, the second and third ignition plugs are arranged so that the discharge electrode portions of the second and third ignition plugs being inclined inwardly of the combustion chamber in opposite directions and are substantially symmetrical relative with the first ignition plug in plan view. A line intersecting the discharge electrode portions of the second and third ignition plugs forms an oblique angle with the direction of the row of cylinders in plan view.

14 Claims, 7 Drawing Sheets

FOREIGN PATENT DOCUMENTS

| | | |
|---|---|---|
| DE | 19731974 | 1/1999 |
| EP | 1363011 | 11/2003 |
| FR | 2311181 | 12/1976 |
| FR | 2831604 | 5/2003 |
| JP | 60043128 | 3/1985 |
| JP | 05302516 | 11/1993 |
| JP | 06088530 | 3/1994 |
| JP | 7103069 | 4/1995 |
| JP | 08004641 | 1/1996 |
| JP | 2006052666 | 2/2006 |

* cited by examiner

INTERNAL-COMBUSTION ENGINE AND METHOD OF DISPOSING IGNITION PLUG THEREOF

RELATED APPLICATIONS

The disclosures of Japanese Patent Applications Nos. 2005-119432 and 2005-119436, both filed Apr. 18, 2005, including their specifications, claims, and drawings, are incorporated herein by reference in their entireties.

TECHNICAL FIELD

Described herein are embodiments of a spark ignition internal-combustion engine, and more particularly, a multi-point-ignition internal-combustion engine having a plurality of ignition plugs for respective cylinders, and a method of disposing such ignition plugs.

BACKGROUND ART

An example of the conventional art of multi-point ignition internal-combustion engines is disclosed in Japanese Published Patent Application No. 2004-107647. In the prior internal-combustion engine, three ignition plugs are provided for each cylinder along a principal axial direction and multi-point ignition is carried out, for the purpose of reducing the period of combustion, particularly during exhaust and reflux when combustion is stagnant.

DISCLOSURE OF INVENTION

Advantageous Effects

In the present engine, two sets of inlet valves and outlet valves are disposed within the combustion chamber. A first ignition plug is disposed within a central area of each cylinder in plan view. Second and third ignition plugs are disposed in the cylinder head adjacent to the inlet valves and outlet valves, respectively, of the cylinder. The discharge electrode portions of the second and third ignition plugs are inclined inwardly relative to the cylinder when viewed in elevation relative to the engine. The discharge electrode portions of the second and third ignition plugs are symmetrical with the discharge electrode portion of the first ignition plug, and the discharge electrode portions of the second and third ignition plugs are aligned at an oblique angle to the direction of alignment of the row of cylinders.

The present method relates to disposing the ignition plugs in such a manner as described above.

DESCRIPTION OF DRAWINGS

These and other features of the present engine and method will be apparent from the following detailed description taken in conjunction with the accompanying drawings, in which.

MODE FOR INVENTION

Figure 1:
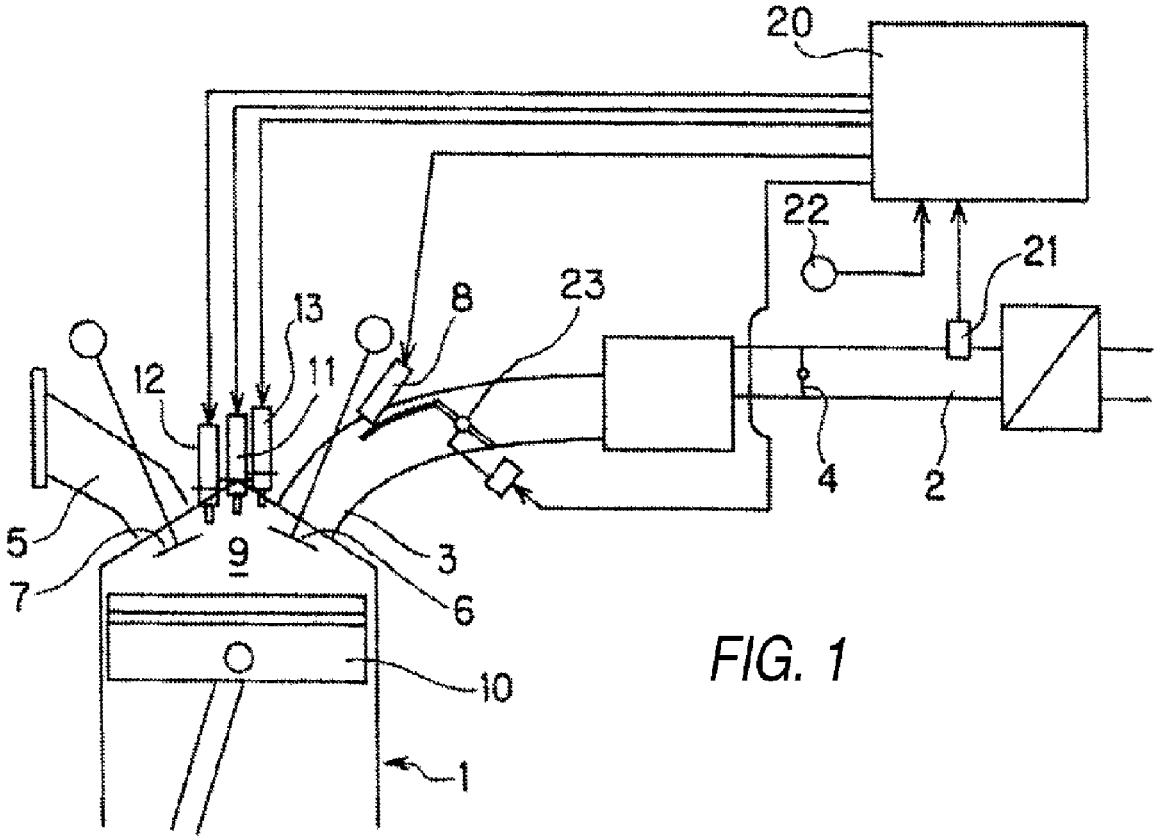
FIG. 1 is a general schematic view of the present internal-combustion engine.

Hereinafter, embodiments of the invention will be described with reference to the drawings. The common parts to each embodiment are designated by using the same reference numeral in the Figures.

FIG. 1 shows a general schematic configuration of a first embodiment of the present internal-combustion engine. A multiple-cylindered internal-combustion engine 1 having a row of cylinders disposed in a principal axial direction is shown. Engine 1 includes an inlet path 2, an inlet port portion 3, a throttle valve 4, an outlet port portion 5, an inlet valve 6, an outlet valve 7, a fuel injection valve 8, a combustion chamber 9, a piston 10, and ignition plugs 11, 12, 13. The engine 1 is also provided with a control unit 20, an inlet air volume sensor 21, and a crank angle sensor 22. A control valve 23 is provided for causing a swirl within the cylinder and is configured to cause an inlet swirl by narrowing the flow passage area of the inlet path 2 under relatively low load operating conditions based on an instruction from the control unit 20, thereby increasing the velocity of inlet flow to the cylinder.

The control unit 20, preferably a microcomputer comprising a CPU and peripheral devices thereof, judges the operational status of the engine based on inputs from the respective sensors 21 and 22, and controls operation of the fuel injection valve 8 and the ignition plugs 11, 12, 13 so that fuel injection timing, injection amount and ignition timing, respectively may reach a predetermined target volume.

Figure 2:
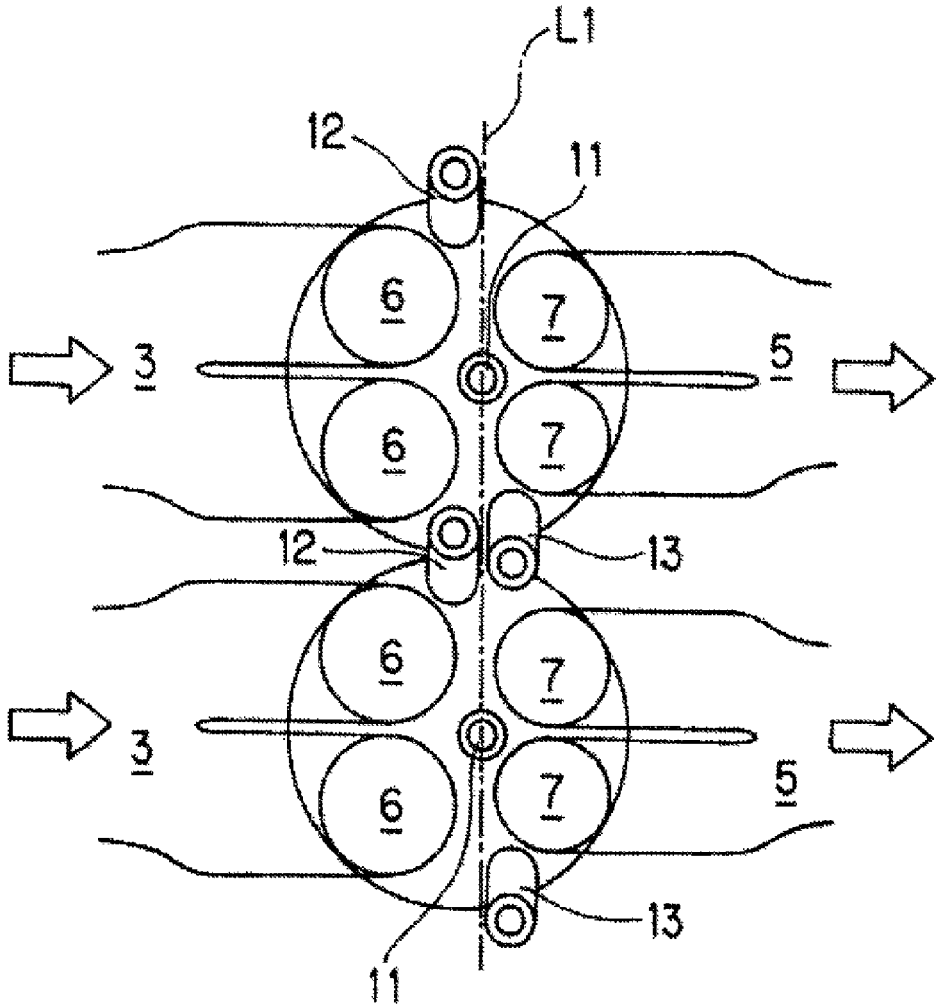
FIG. 2 is a plan view showing the disposition of ignition plugs in accordance with a first embodiment of the present engine.

FIG. 2 shows in detail the disposition of the three ignition plugs 11, 12, and 13 in each cylinder. The term 'front view' is used herein to indicate a view from the front of the engine or the principal axial direction of the internal combustion engine. The term 'plan view' indicates a view from above the combustion chamber or the axial direction of the cylinder. The term 'side view' indicates a view from a direction perpendicular to both the principal axis of the engine and the axis of the cylinder.

The internal-combustion engine of this embodiment is constituted by four valves for each cylinder, including a pair of inlet valves 6 and a pair of outlet valves 7, each of the pairs being aligned with the principal axial direction in the plan view of FIG. 2. The pairs of inlet valves and outlet valves are positioned opposite each other so as to be aligned along a second axis and third axis, respectively, that are perpendicular to the first axis of the generally aligned row of cylinders in plan view. Of the three ignition plugs, a first ignition plug 11 is located at a generally central region of the combustion chamber 9 surrounded by the four valves 6 and 7. A second ignition plug 12 and a third ignition plug 13 are located at circumferential regions of the combustion chamber 9 somewhat beyond the inlet valves 6 and outlet valves 7 and are arranged so as to be substantially symmetrically disposed relative to the first ignition plug 11.

Figure 3:
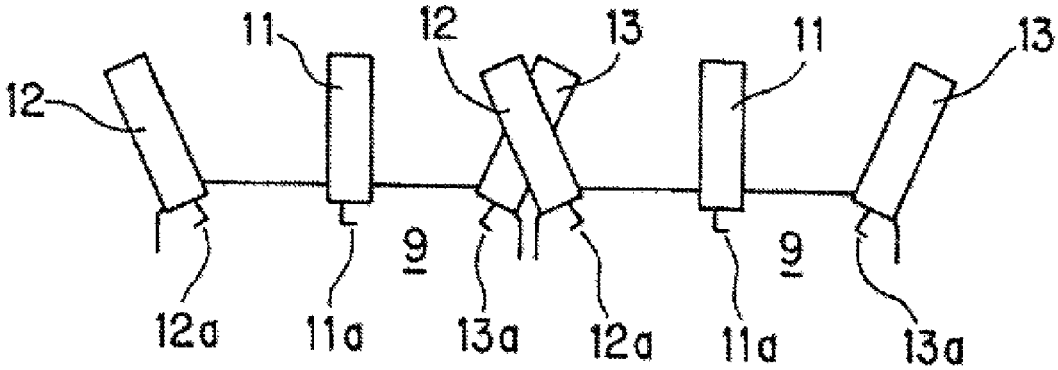
FIG. 3 is a side view also showing the disposition of the ignition plugs of FIG. 2.

Moreover, the second ignition plug 12 and third ignition plug 13 are mounted to incline so that their discharge electrodes 12*a* and 13*a* (FIG. 3) are directed inwardly of the cylinder in side view. The second ignition plug 12 and the third ignition plug 13 are located on opposite sides of a reference line L1 passing through the first ignition plugs 11 of respective cylinders, whereby the second ignition plugs 12 and third ignition plugs 13 of adjacent cylinders do not interfere with each other. The configuration in which an ignition plug 12 or 13 is located to one side of the reference line L1 is not necessarily applied to ignition plugs located at the far circumferential edges of cylinders at the ends of the cylinder row since there is no problem of positional interference for these plugs.

With the above-described disposition of the ignition plugs 12 and 13, the distance between adjacent cylinders can be minimized, and the weight and size of the engine can be reduced. In addition, with this disposition of the ignition plugs, the diameter of the inlet valves 6 and the outlet valves 7 can be maximized, whereby output performance is not impaired. With the discharge electrode portions 12*a* and 13*a* of the second and third ignition plugs 12 and 13 being located at circumferential regions of the cylinder and inclined inwardly of the cylinder, the initial combustion flame can be more evenly distributed upon ignition during the low starting temperature, the stability of combustion can be raised, and combustion can be certainly reduced.

Figure 4:
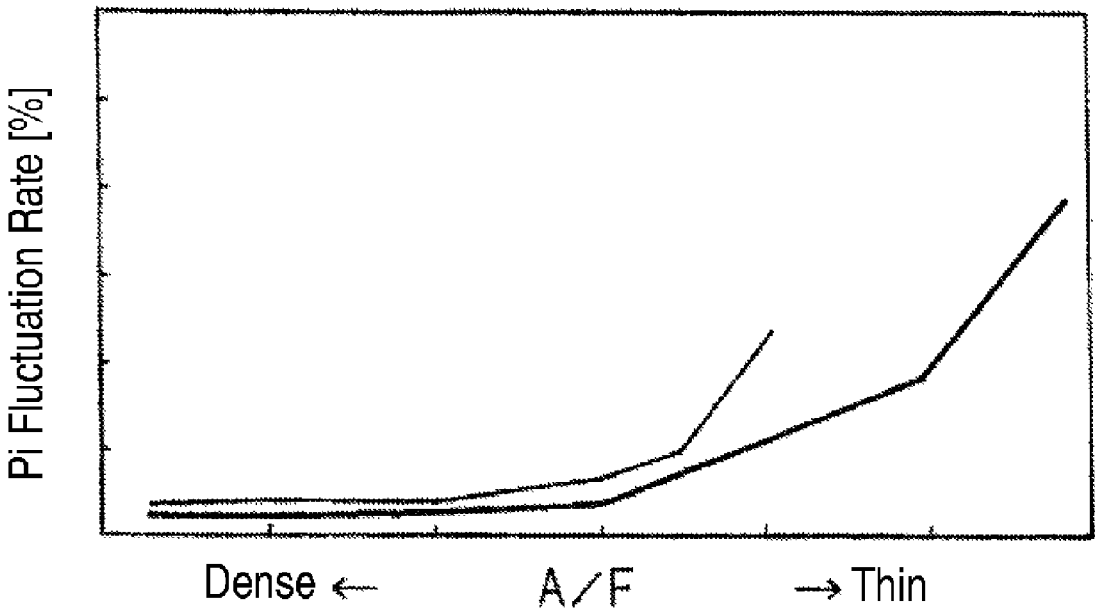
FIG. 4 is a graph showing the relationship between P fluctuation rate and air-fuel ratio in accordance with the embodiment.
Figure 5:
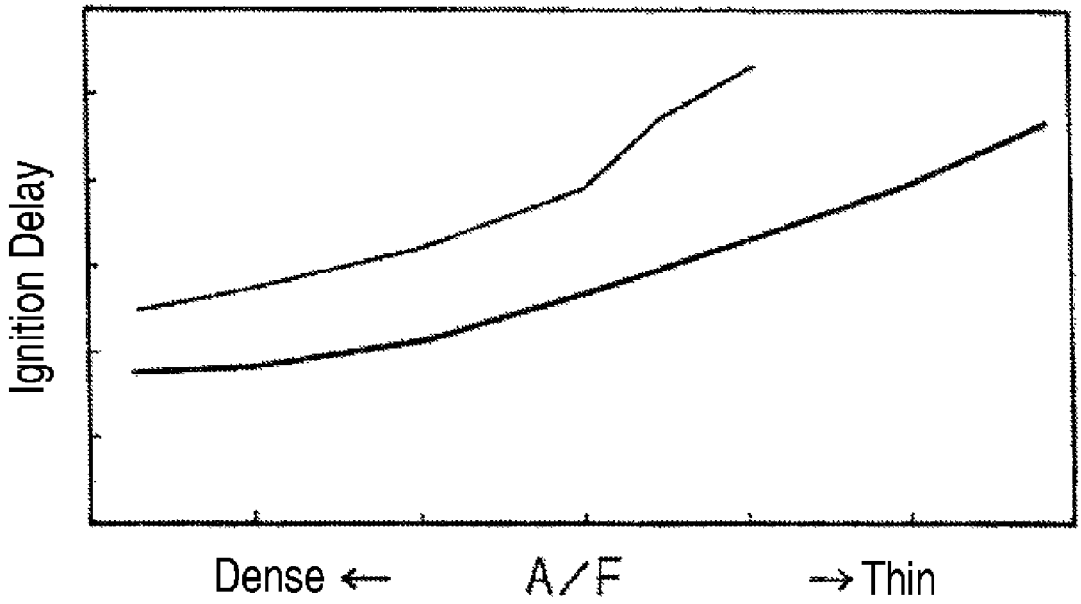
FIG. 5 is a graph showing the relationship between ignition delay and air-fuel ratio in accordance with the embodiment.

FIGS. 4 to 7 illustrate results experimentally confirming the improvement in combustion. FIG. 4 and FIG. 5 examine the relationship between air-fuel ratio (A/F), on the one hand, and, on the other hand, respectively, the fluctuation rate of average effective pressure (Pi) displayed and ignition delay time in low temperature starting. In these drawings, a thin line represents one-point ignition by an ignition plug in the center of the combustion chamber and a thick line represents three-point ignition by the three ignition plugs of this embodiment.

As illustrated in FIGS. 4 and 5, in three-point ignition according to the above described embodiment, the operation is stable in thin air-fuel ratios compared to one-point ignition in the same Pi fluctuation rate, or the ignition delay is rare up to thin air-fuel ratio region, whereby combustion stability becomes higher.

Figure 6:
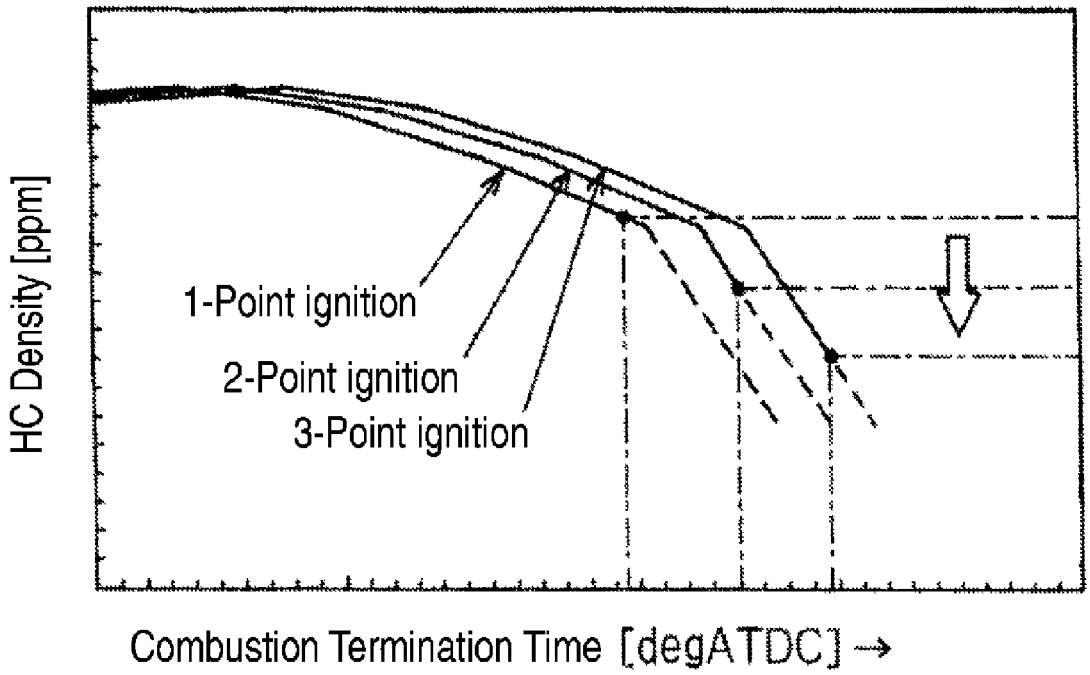
FIG. 6 is a graph showing the relationship between exhausted HC density and combustion termination time in accordance with the embodiment.
Figure 7:
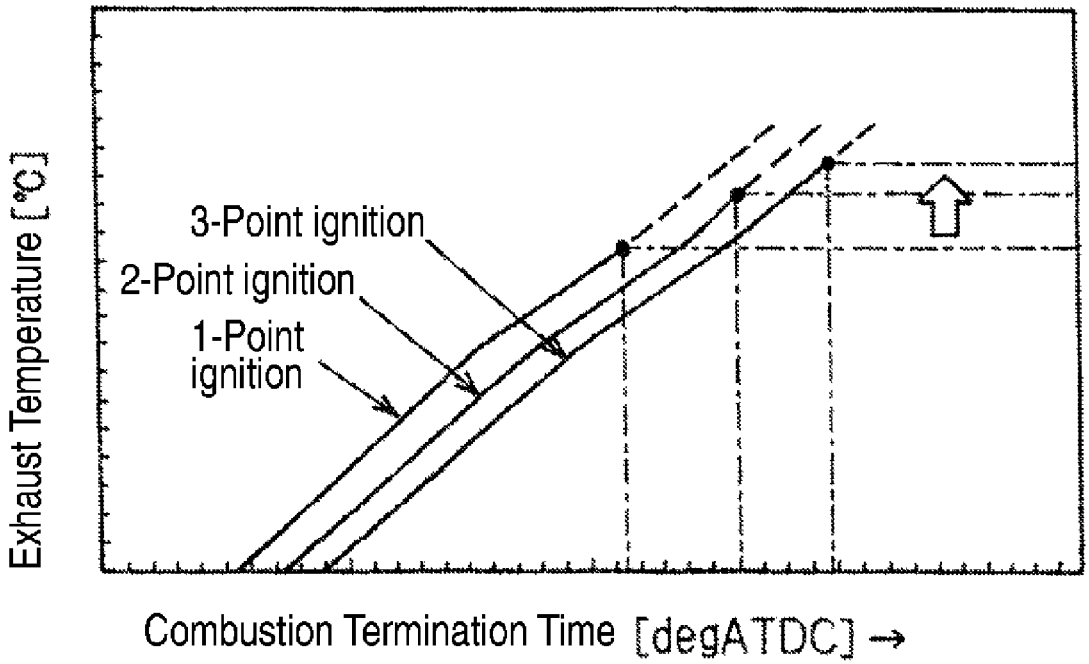
FIG. 7 is a graph showing the relationship between exhaust temperature and combustion termination time in accordance with the embodiment.

FIG. 6 and FIG. 7, respectively, show the relationship between the combustion termination time and exhausted HC amount or exhaust temperature. As shown in FIG. 6, compared with one-point ignition by only a central ignition plug or two-point ignition omitting the central ignition plug, since three-point ignition of this embodiment reduces combustion time, three-point ignition can further delay the combustion termination time, the exhausted HC density thereby being lowered. In addition, as shown in FIG. 7, in comparison with one-point ignition or two-point ignition, delaying the combustion time further increases the exhaust temperature, thereby promoting activation of the exhaust purification catalyst. Consequently, exhaust emission performance also can be improved.

Furthermore, with the configuration in which the second ignition plug 12 and the third ignition plug 13 in neighboring cylinders are adjacent to each other, cooling can be improved for each ignition plug. Generally a coolant jacket is formed in a manner such that coolant flows along the direction of the row of cylinders from one end portion thereof to the opposite end portion. Accordingly, in the conventional engine, if the ignition plugs adjacent to each in neighboring cylinders are arranged along the same straight line, the cooling of the plug downstream of the coolant flow is relatively insufficient, whereby ignition performance may be impaired. With the configuration of the present engine, in which the positional interference of two neighboring ignition plugs, such as the ignition plug 12 and the adjacent ignition plug 13, is avoided, the flow of coolant toward each ignition plug is evenly distributed, whereby proper cooling can be implemented.

With the disposition of the ignition plugs in the embodiment described above, in which positional interference of the adjacent ignition plugs can be avoided, the distance between cylinders can be minimized. In addition, since the plugs 12 and 13 can be located at the utmost circumferential region of each combustion chamber 9, the diameter of an inlet valve 3 or an outlet valve 5 can be maximized.

Moreover, if the discharge electrode portions of the second and third ignition plugs 12 and 13 are directed inwardly of the cylinder when viewed from the side, combustion time can be further reduced, compared to the arrangement in which the ignition plugs at the periphery of each combustion chamber 9 are parallel to the center line of the cylinder. Inclining the ignition plugs in this manner might cause a problem of interference between the plugs of adjacent cylinders, but such interference can be avoided by the offset configuration of the plugs in the present engine.

Finally, since coolant flow can be supplied evenly to the two neighboring ignition plugs, imbalance in cooling status for each ignition plug is avoided, whereby stable ignition performance is achieved.

Figure 8:
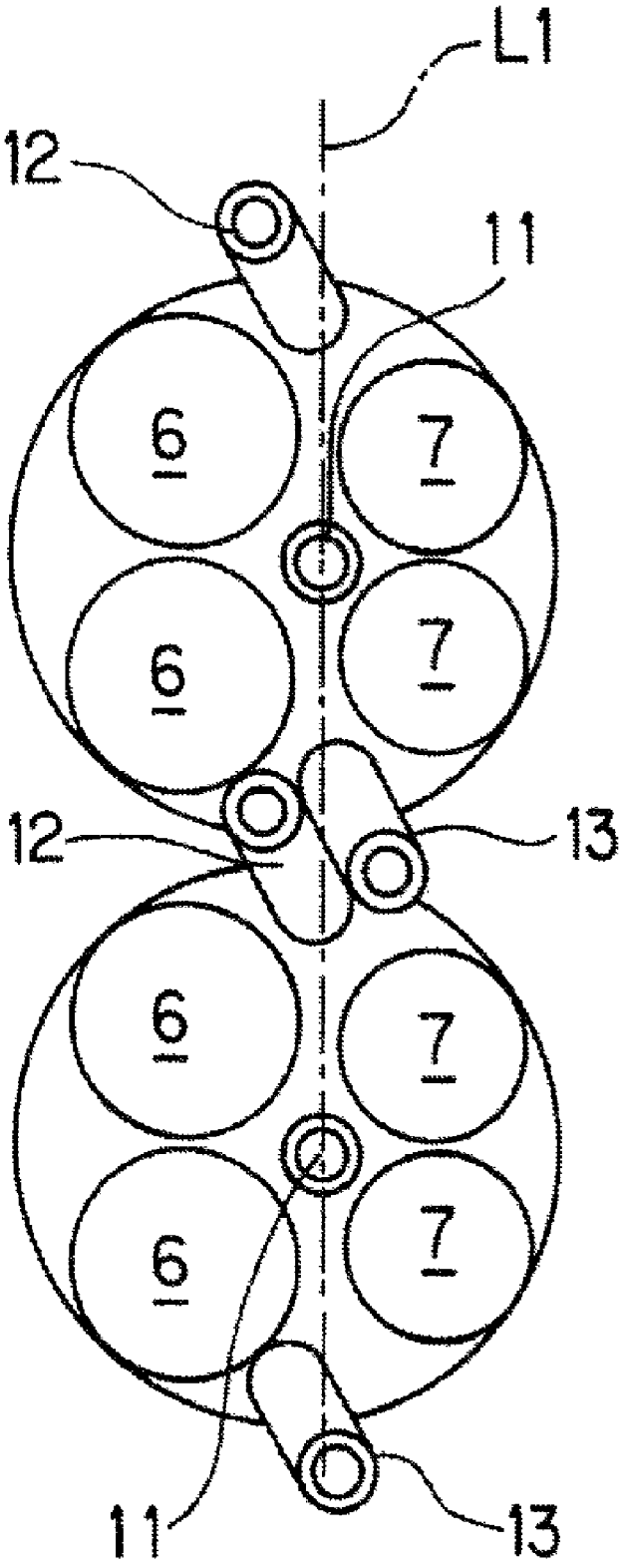
FIG. 8 is a plan view showing the disposition of ignition plugs in accordance with a second embodiment of the engine.
Figure 9:
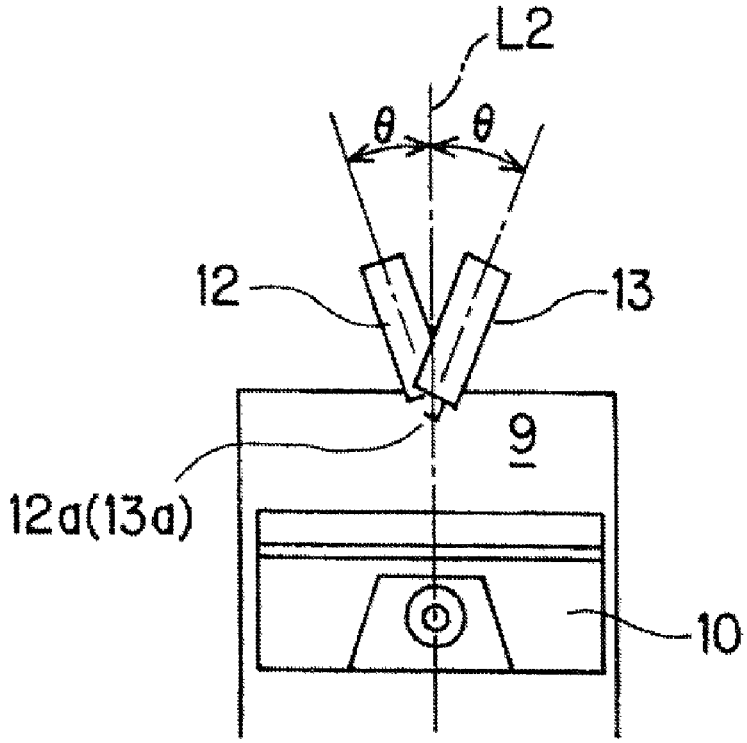
FIG. 9 is a front view also showing the disposition of the ignition plugs of FIG. 8 and FIG. 11.

FIGS. 8 and 9 illustrate a second embodiment of the disposition of the ignition plugs in accordance with the present engine. In this embodiment, as shown in FIG. 9, when the second ignition plug 12 and the third ignition plug 13 are viewed from the front, an angle of incline, q, to a center line L2 of the cylinder is established and the incline direction is varied, so that positional interference between the neighboring ignition plugs is avoided. Furthermore, the angle of incline, q, may be established for either side of two ignition plugs 12 and 13.

Figure 10:
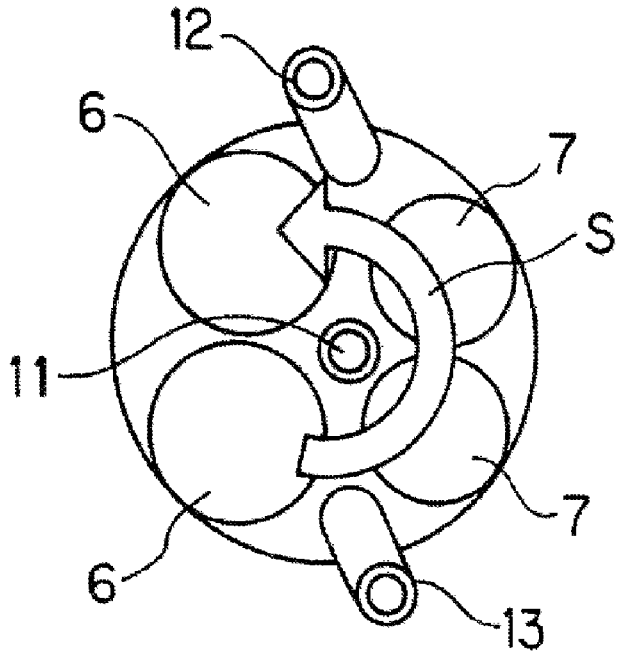
FIG. 10 is a plan view showing the relationship between a direction of swirling and the inclination of the ignition plugs of FIGS. 8 and 9.

In this embodiment, based on the establishment of the angle of incline, q, since the positional interference of the ignition plugs 12 and 13 adjacent to each other between the cylinders can be avoided and the discharge electrode ports 12*a* and 13*a* are close to the center line L2 of the cylinder, further equalization of the distribution of the combustion flame within the cylinder can be expected. In addition, as shown in FIG. 10, if a swirl S occurs in the inlet current from the inlet valve 6 on one side, the direction of the angle of incline, q, is determined so that the discharge electrode portions 12*a* and 13*a* are opposed to the flow of the swirl S, and ignition performance is improved, thereby reducing the time of ignition delay.

Figure 11:
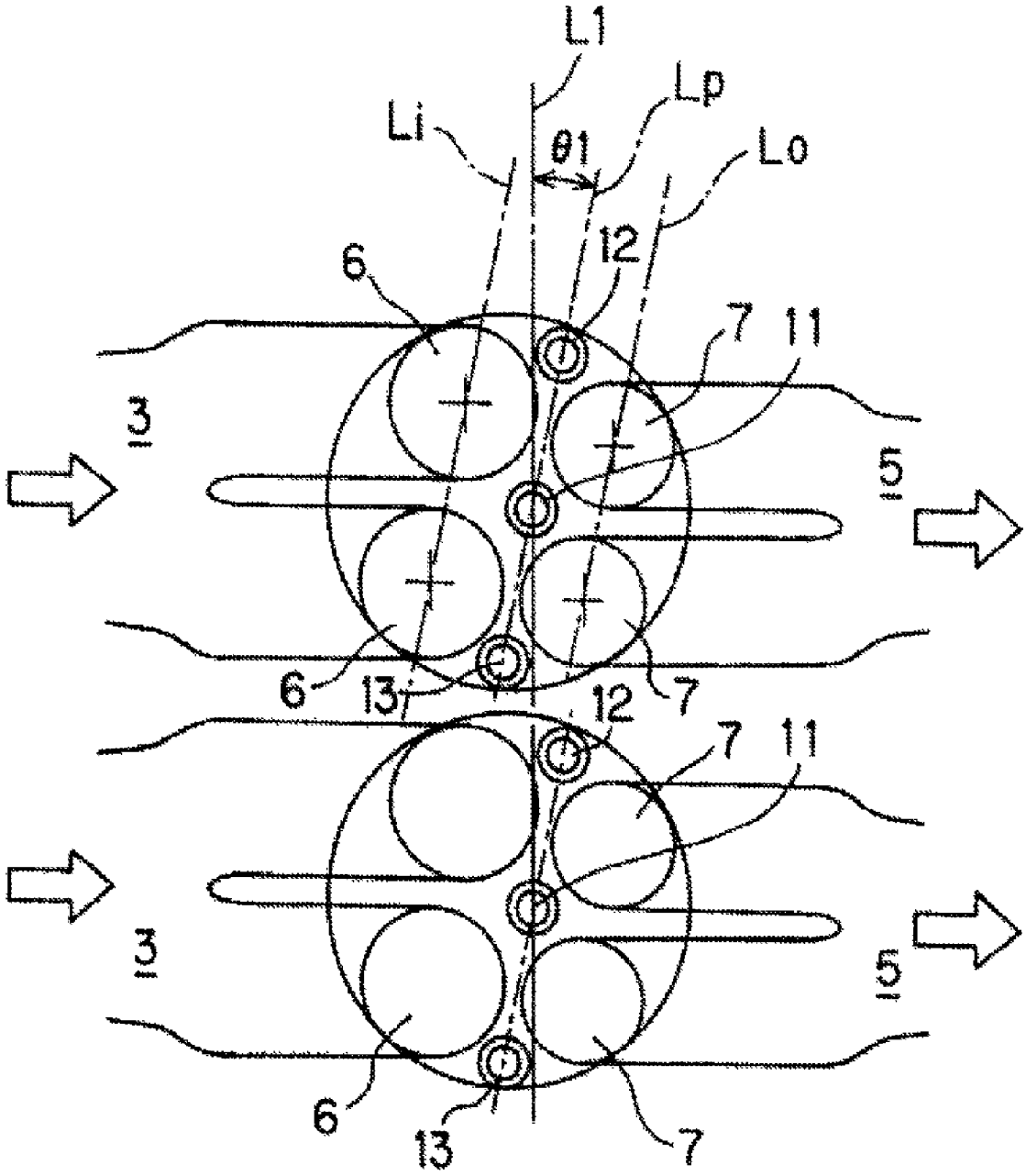
FIG. 11 is a plan view showing the disposition of ignition plugs in accordance with a third embodiment of the present engine.

A third embodiment of the present engine is represented in FIG. 11. In each cylinder, the second and third ignition plugs 12 and 13, inlet valve 6 and outlet valve 7 are disposed so that lines passing through the central mounting portion of the second and third ignition plugs 12 and 13, $L_P$, lines passing through a center of the valve opening in 2 inlet valves 6, $L_i$, and lines passing through a center of the valve opening, $L_o$ are inclined with respect to a principal axis or a center line of cylinder row, L1 in the same direction by an angle of incline, q 1. In addition, in this case, $L_P$, $L_i$ and $L_o$ are preferably established at substantially the same angle of incline, q 1, but this is not essential.

Furthermore, in this embodiment, the second and third ignition plugs 12 and 13 are mounted to be inclined so that the discharge electrode portions 12*a* and 13*a* are directed inwardly of the cylinder when viewed from the side.

With this configuration, since two ignition plugs, such as the second ignition plug 12 and third ignition plug 13, differ in their disposition relative to the center line of the cylinder, L1, so that positional interference with each other can be avoided, here again the distance between adjacent cylinders can be minimized, whereby the weight and size of the engine can be reduced. And here again, with this disposition of the ignition plugs, the valve diameter of the inlet valve 6 or the outlet valve 7 can be maximized, whereby output performance is not impaired. In this embodiment, too, the discharge electrode portions 12*a* and 13*a* of the second ignition plug 12 and third ignition plug 13, being located at circumferential regions and inclined inwardly of the cylinder, the initial flame can be more evenly distributed after ignition in low temperature starting, the stability of the combustion can be enhanced, and combustion time can be certainly reduced.

Furthermore, with this configuration, as shown in FIG. 11, one of the inlet valves 6 (hereinafter, referred to as 'inner inlet valve') is located further from the center line of the row of cylinders, L1, in plan view than the other inlet valve 6. That is, an inlet portion of the inlet valve corresponding to an outlet of the inlet port portion 3 (FIG. 1) located at a side of the combustion chamber is opened at a position farther from the center of the cylinder. Accordingly, the control valve 23 (FIG. 1.) can cause more effective swirl in this configuration in which the swirl is induced from the inner inlet valve 6.

With a configuration to cause the swirl in such manner, as shown in FIG. 9, which applies as well to this embodiment, the second or third ignition plug 12 or 13 is inclined with respect to a center line of the cylinder, L2 by an angle of inclination, q 2, when viewed from the front, whereby the discharge electrode portion 12*a* or 13*a* is opposed to the flow of the swirl. However, the angle of inclination, q 2, may be established for any one side of two ignition plugs 12 and 13. In addition, if the direction of the angle of inclination, q 2, is established so that the discharge electrode portion 12*a* or 13*a* is opposed to the flow of the swirl S, ignition performance is improved, thereby reducing the time of ignition delay.

In this embodiment, the three ignition plugs are serially arranged in each cylinder and the inlet valves are formed to rotate substantially around a center line of the cylinder by the angle of incline q. Consequently, since the second and third ignition plugs 12 and 13 in a periphery of each other between neighboring cylinders are dissimilarly disposed about the center line of the cylinder L1, a positional interference of the two ignition plugs can be avoided, whereby a gap between cylinders may be minimized. In addition, since the neighboring two ignition plugs can be located at an utmost circumferential region of each combustion chamber of the cylinder, the valve diameter of an inlet valve 3 or an outlet valve 5 can be secured to the maximum.

Additionally, according to the present invention, since cooling water can be evenly supplied to two neighboring ignition plugs, the imbalance of cooling status for each ignition plug is avoided, whereby the stable ignition performance being exhibited.

While the present engine and method have been described in connection with certain specific embodiments thereof, this is by way of illustration and not of limitation, and the appended claims should be construed as broadly as the prior art will permit.

The invention claimed is:

1. An internal-combustion engine comprising:

a cylinder block having a plurality of cylinder bores generally aligned along a first axis to form a row of cylinders;

a plurality of pistons, each of the pistons being received in a respective one of the cylinder bores;

a cylinder head coupled with the cylinder block and cooperating with the cylinder bores and pistons to form a combustion chamber in each of the cylinders, the cylinder head being formed with an inlet path and an outlet path opening into the combustion chamber;

a pair of inlet valves and a pair of outlet valves disposed within the combustion chamber;

a first ignition plug disposed in the cylinder bead within a generally central area of the combustion chamber in plan view; and second and third ignition plugs disposed in the cylinder head at opposite peripheral portions of the combustion chamber positioned approximately along the first axis direction in plan view;

the second and third ignition plugs being arranged so that discharge electrode portions of the second and third ignition plugs are inclined inwardly of the combustion chamber in opposite directions;

the discharge electrode portions of the second and third ignition plugs being disposed substantially symmetrical relative to the first ignition plug in plan view, a line intersecting the discharge electrode portions of the second and third ignition plugs forming an oblique angle with the first axis of the row of cylinders in plan view.

2. An internal-combustion engine according to claim 1, wherein the discharge electrode portions of the second and third ignition plugs are inclined inwardly of the combustion chamber in opposite directions when viewed from the side of the engine.

3. An internal-combustion engine according to claim 2, wherein the second ignition plug and the third ignition plug are inclined so as to form an oblique angle with a center axis of the cylinder bore when viewed from the front of the engine.

4. An internal-combustion engine according to claim 3, wherein the incline of the second ignition plug or the third ignition plug is established so that the discharge electrode portion thereof is opposed to the flow of a swirl induced from one of the inlet valves.

5. An internal-combustion engine according to claim 1, wherein the second ignition plug of one of the cylinders and the third ignition plug of another cylinder adjacent to the one of the cylinders are located on opposite sides of a reference line passing through the first ignition plugs of the cylinders in plan view.

6. An internal-combustion engine according to claim 5, wherein the discharge electrode portions of the second and third ignition plugs are inclined inwardly of the combustion chamber in opposite directions when viewed from the side of the engine.

7. An internal-combustion engine according to claim 6, wherein the second ignition plug and the third ignition plug are inclined so as to form an oblique angle with a center axis of the cylinder bore when viewed from the front of the engine.

8. An internal-combustion engine according to claim 7, wherein the incline of the second ignition plug or the third ignition plug is established so that the discharge electrode portion thereof is opposed to the flow of a swirl induced from one of the inlet valves.

9. An internal-combustion engine according to claim 1, wherein a line intersecting the discharge electrode portions of the second and third ignition plugs, a line intersecting the centers of valve openings of the pair of inlet valves, and a line intersecting the centers of valve openings of the pair of outlet valves all form oblique angles in the same direction with the first axis of the row of cylinders.

10. An internal-combustion engine according to claim 9, wherein the discharge electrode portions of the second and third ignition plugs are inclined inwardly of the combustion chamber when viewed from the side the engine.

11. An internal-combustion engine according to claim 10, wherein the incline of the second ignition plug or the third ignition plug is established so that the discharge electrode portion thereof is opposed to the flow of a swirl induced from one of the inlet valves.

12. An internal-combustion engine according to claim 11, wherein the swirl is induced through one of the pair of inlet valves on a side adjacent to the first axis in a plan view of the engine.

13. A method of disposing ignition plugs in an internal-combustion engine, comprising the steps of:

disposing a pair of inlet valves and a pair of outlet valves about a first principal axis in which a row of cylinders are positioned;

disposing a first ignition plug in a generally central region of a combustion chamber such that the first ignition plug is generally surrounded by the inlet valves and outlet valves when viewed in plan view; and disposing second and third ignition plugs in a circumferential regions of the combustion chamber positioned opposite approximately along the first axis direction and substantially symmetrical with respect to the first ignition plug when viewed in plan view, the second ignition plug of one of the cylinders and the third ignition plug of another cylinder adjacent to the one of the cylinders being located on opposite sides of a reference line passing through the first ignition plugs of the cylinders in plan view, whereby the second and third ignition plugs are partially overlapping when viewed from the side of the engine.

14. An internal-combustion engine comprising:

a cylinder block having a plurality of cylinder bores generally aligned along a first axis to form a row of cylinders;

a combustion means that includes a combustion chamber, wherein the combustion means is formed with an inlet path and an outlet path opening into the combustion chamber;

a pair of inlet valves and a pair of outlet valves disposed within the combustion chamber;

a first ignition means disposed in the cylinder head within a generally central area of the combustion chamber in plan view; and second and third ignition means disposed in the cylinder head at opposite peripheral portions of the combustion chamber positioned approximately along the first axis direction in plan view, the second and third ignition means being arranged so that discharge means of the second and third ignition means are inclined inwardly of the combustion chamber in opposite directions, the discharge means of the second and third ignition means being disposed substantially symmetrical relative to the first ignition means in plan view, a line intersecting the discharge means of the second and third ignition means forming an oblique angle with the first axis of the row of cylinders in plan view.

* * * * *